United States Patent [19]

Imhoff et al.

[11] Patent Number: 5,009,572

[45] Date of Patent: Apr. 23, 1991

[54] WATER CONSERVATION DEVICE

[76] Inventors: Ray Imhoff, 1824 Arlington Ave., El Cerrito, Calif. 94530; Sadraddin Seif, 933 Lorna St., Corona, Calif. 91720

[21] Appl. No.: 422,247

[22] Filed: Oct. 16, 1989

[51] Int. Cl.[5] ..... F04B 49/00

[52] U.S. Cl. ..... 417/32; 417/63; 137/337

[58] Field of Search ..... 417/32, 63; 137/337; 236/12.12

[56] References Cited

U.S. PATENT DOCUMENTS

| | | | |
|---|---|---|---|
| 3,543,836 | 12/1970 | Paulson | 137/337 |
| 3,885,584 | 5/1975 | Hock | 137/624.2 |
| 4,201,518 | 5/1980 | Stevenson | 417/32 |
| 4,606,325 | 8/1986 | Lujan, Jr. | 417/32 |

*Primary Examiner*—Leonard E. Smith
*Assistant Examiner*—David W. Scheuermann
*Attorney, Agent, or Firm*—Poms, Smith, Lande & Rose

[57] ABSTRACT

Herein described is a compact and self-contained circular water conservation device which can be easily installed in conjunction with existing and non-existing plumbing systems and fixtures having a source of pressurized water, a hot water supply line, a cold water supply line, a hot water heater, and outlet fixtures coupled to the hot and cold water supply lines. The water conservation device includes essentially an elecric water pump for pumping water from the hot water supply line into a solenoid valve. The solenoid valve prevents the mixture of hot and cold water systems. The solenoid valve is coupled to the cold water line directly leading to and coupled to an outlet fixture. A thermostat temperature sensor is provided for detecting the hot water temperature at the inlet port of the pump. The water conservation device, when in operation, creates a closed loop linking the hot water line to the cold water line. The device moves the cooled hot water into the cold water line, causing immediate hot water to exit any hot water fixture outlet and, thus, conserving water in the process. The device does not require the hot water to be recirculated to the hot water heater. The device is easy to install by any homeowner and is small enough to fit inside a standard bathroom vanity.

5 Claims, 6 Drawing Sheets

WATER CONSERVATION DEVICE

BACKGROUND AND SUMMARY OF THE INVENTION

The invention relates to the conservation of potable water which is generally run down a drain while the user waits for heated water to be drawn to the faucet for use in washing, bathing, showering, cooking, etc. It is to be understood that the water conservation device is intended for, but not limited the water conservation device is intended for, but not limited to, household use.

A need has existed for a convenient and economical way to prevent the waste of potable water especially in the home. Currently, potable water is wasted each time a person needs heated water. The hot water tap is turned on and potable water which has cooled in the plumbing pipes is washed down the drain until heated water reaches the tap. On an average, between two and three gallons of water can be washed down the drain each time heated water is required. This waste of precious potable water can now be easily and economically prevented. This applies to water at the kitchen, bathroom, laundry room, etc., sinks and showers.

While many communities are restricting water usage, gallons of potable water are wasted every day in every household waiting for heated water to be delivered to the faucet.

There is an immediate need for an effective, simple way to conserve otherwise wasted water. It needs to be convenient so as not to require any labor or effort on the part of the user. This invention provides both the convenience of immediate hot water, while at the same time conserving, with no effort on the part of the user, gallons of water normally washed down the drain.

In an average household with four persons, approximately 20 gallons of water are wasted each day when the hot water tap is turned on either at the sink, tub or shower waiting for the water to reach a desired temperature.

The invention is designed to operate so that when the water temperature drops below a set temperature on the thermostat (the temperature is set by the user to his/her desired temperature of water), the action of the thermostat is such that it will turn on a pump and open a solenoid valve. In this manner, hot water which has cooled in the hot water pipes will be pumped from the hot water line into the cold water line. Conversely, when the hot water warms and reaches thermostat is such that it will turn off the pump and will close the solenoid valve to stop the flow of water. With this process, the hot water will maintain a generally constant temperature (from the point at which the thermostat is set, the water temperature may drop to a lower pre-set temperature on the thermostat) at all times eliminating the wasting of cooled hot water from the hot water line while waiting for heated water to be available at the faucet for use. Included as part of the invention is a light on the unit which will be lit when the water temperature has reached the pre-set temperature range.

It is, therefore, an object of the invention to provide immediate hot water at the faucet, saving gallons of wasted water per each use in the average household.

It is another object of the invention to be able to set a desired temperature at which hot water can be drawn from the faucet for use.

It is another object of the invention that the water conservation device be economical and available to the user. This will be an inexpensive device that will be easily affordable for household and other use. It will make practical water conservation available to everyone in their own home, or place of business.

It is another object of the invention that when the high thermostat temperatures are selected, warm water may be present in the cold water line. This may be undesirable to some users; therefore, as an option a small water tank or coil pipe may be supplied to eliminate this condition.

It is another object of the invention that moderate temperatures be selected which would result in further conservation of energy, which the objectives of the invention are also served.

It is another object of the invention that the water conservation device be easily installed in conjunction with existing plumbing fixtures and by any homeowner with little knowledge of plumbing systems using common tools. It can be installed in as little as 15 to 30 minutes.

It is another object of the invention that it be small. The invention is designed to occupy very little space, approximately 7"×7"×4" and is designed also to sit in all water closet cabinets with hot and cold water plumbing.

It is another object of the invention (Embodiment No. 1) that it be easily moved and installed for use at another faucet if so desired by the user.

It is another object of the invention to require little or no human interference or effort in the operation of the device and in the conservation of water. The device when plugged into a standard 110 v outlet (the device can be designed to work with any standard voltage, or battery power, depending on availability of power and cost), and when switched "on" will operate automatically thereafter. A constant initial water temperature will be maintained at whatever temperature the device thermostat is set. If the temperature drops below a preset temperature on the thermostat, the sensory control switch will detect the reduced temperature, start the water pumping so that heated water from the hot water heater will be drawn to the water outlet.

It is another object of the invention to make it easy for the user, a light will turn on when the water is at the temperature desired for use.

It is another object of the invention to be designed for a variety of optional use plans. The device may be designed so that it can be plugged in and set to run automatically or it can be programmed for use at certain times of the day or it can be operated manually each time its use is required.

It is another object of the invention to conserve energy as well as natural resources. The cost of operating the system will vary according to the size of the home and the hours of usage. However, the cost of operating the system, even if set to operate automatically, will be considerably less in cost of electricity usage to operate the device than it costs to pay for the water that would be wasted (and not available for other human needs) without use of the device.

It is another object of the invention to minimize the requirement for its use. When the device is installed at the furthest faucet or tap on a water line, every faucet serviced by the water line will have the same immediate hot water and result in conserved water.

It is another object of the invention to provide a suitable support frame and housing for the water conservation device.

Further objects and advantages for the invention will become more apparent in light of the following description of the preferred embodiments.

DESCRIPTION OF THE PREFERRED EMBODIMENTS

Figure 1:
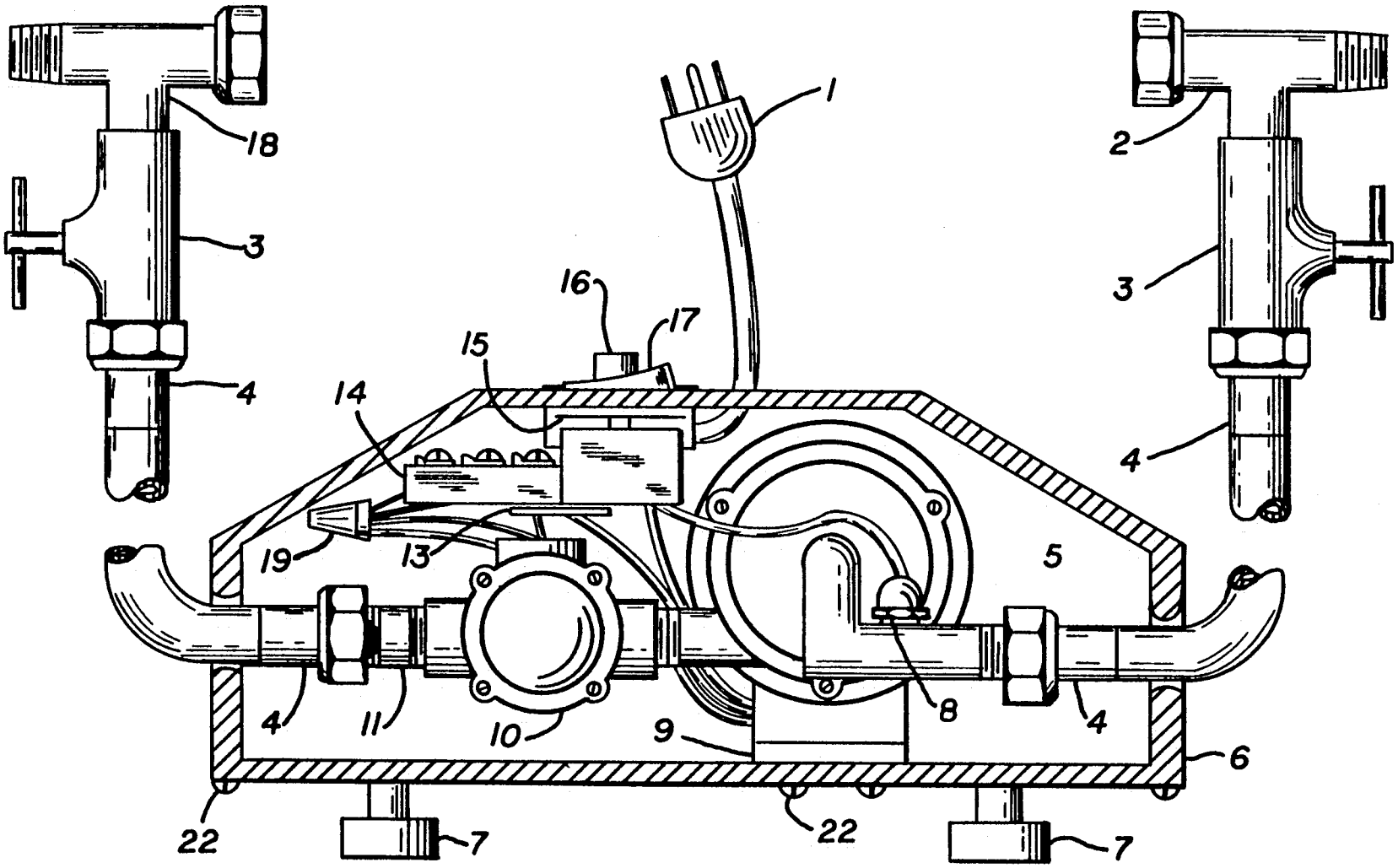
FIG. 1 is a front view of Embodiment No. 1 of the water conservation device with all of it's component parts in one (1) unit.
Figure 2:
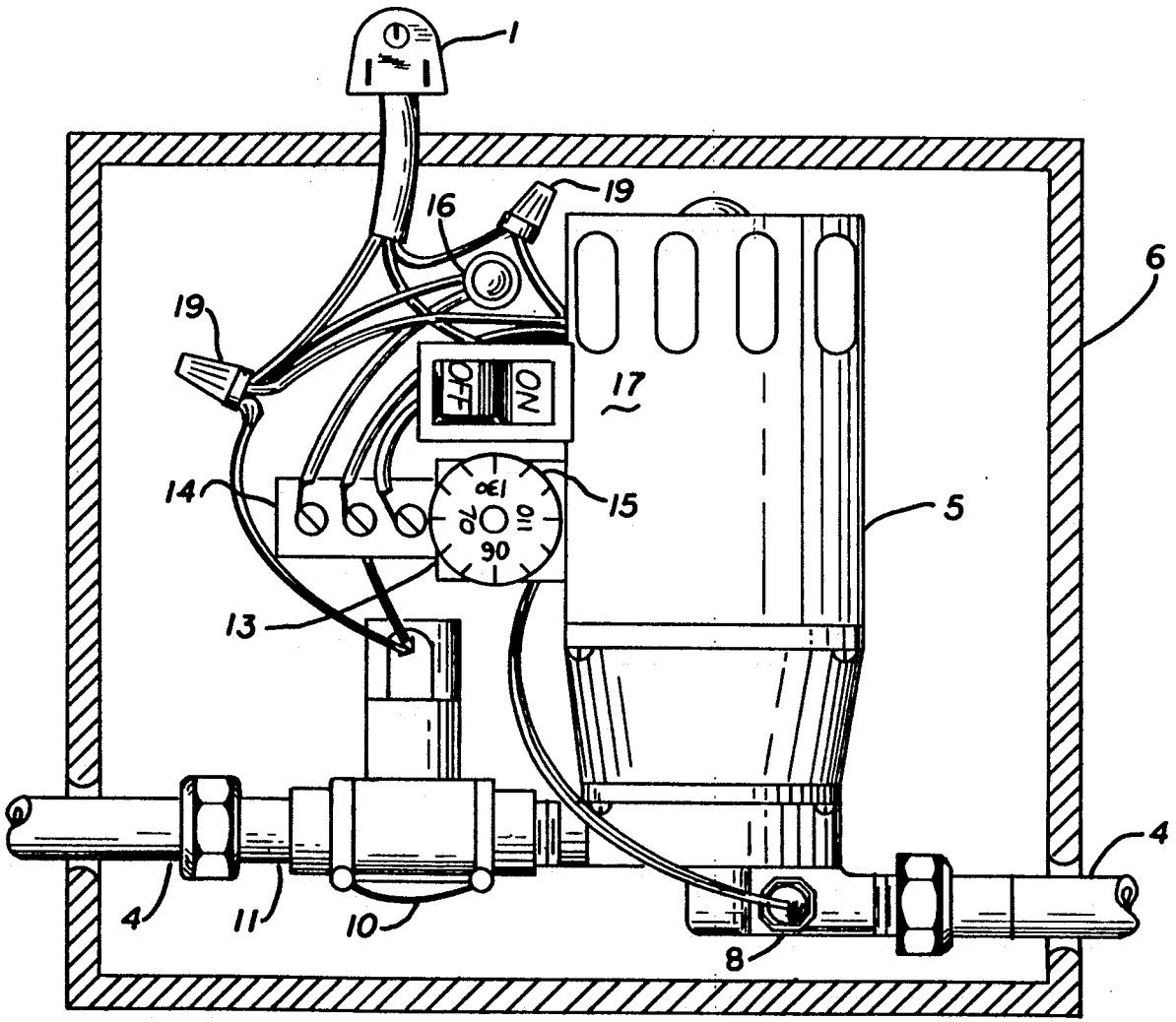
FIG. 2 is a top view of FIG. 1, with items 2, 3 18 and sections of 4 intentionally omitted.

Referring to the drawings and particularly to FIG. 1 and FIG. 2, the invention as shown is constructed of two plumbers tees (2 and 18), one for the hot water line (2) and one for the cold water line (18).

The two plumbers tees have female threads on one end and male threads on two ends as shown in FIG. 1 (2 and 18). It is to be understood that any variation in the diameter of the tees, the thread size and type or shape of the plumbers tee is within the scope of and intent of the invention.

Two shut off valves (3) of the same thread size are installed one to each tee (2) and (18). A one-piece valve and tee combination can be used in place of a separate valve and tee as shown in FIG. 1. This is within the scope and intent of the invention.

Two flexible water lines (4) are connected to the female end of each valve (3). It is to be understood that any other suitable material or thread combination is within the scope and intent of the invention. The flexible line (4) from the hot water line is connected to the inlet side of the pump (5). The electrical pump (5) is of low wattage and has an output of two to five gallons per minute. Any electrical water pump suitable for city water pressure with any output is within the scope and intent of this invention.

The outlet of the electrical pump (5) is connected to a normally closed electrical solenoid valve (10). Any solenoid valve built for city water pressure with any thread size or combination of threads or any check valve or stop valve that would serve the same purpose as a solenoid valve is within the scope and intent of the invention. The purpose of the solenoid valve (10) is to positively separate hot and cold water systems and normally prevent the mixture of hot and cold water at all times when the pump is not operating.

The output end of the solenoid valve (10) is connected to a short nipple (11) to accommodate male threads for the flexible line (4). Variations in the design may require additions or omissions of nipples, fittings, reducers, or other common plumbing fittings. These additions or omissions are within the scope and intent of the invention.

The flexible line (4) from the cold water is connected to the short nipple (11).

The embodiment is installed to both the hot and cold water lines at the desired water closet.

Figure 4:
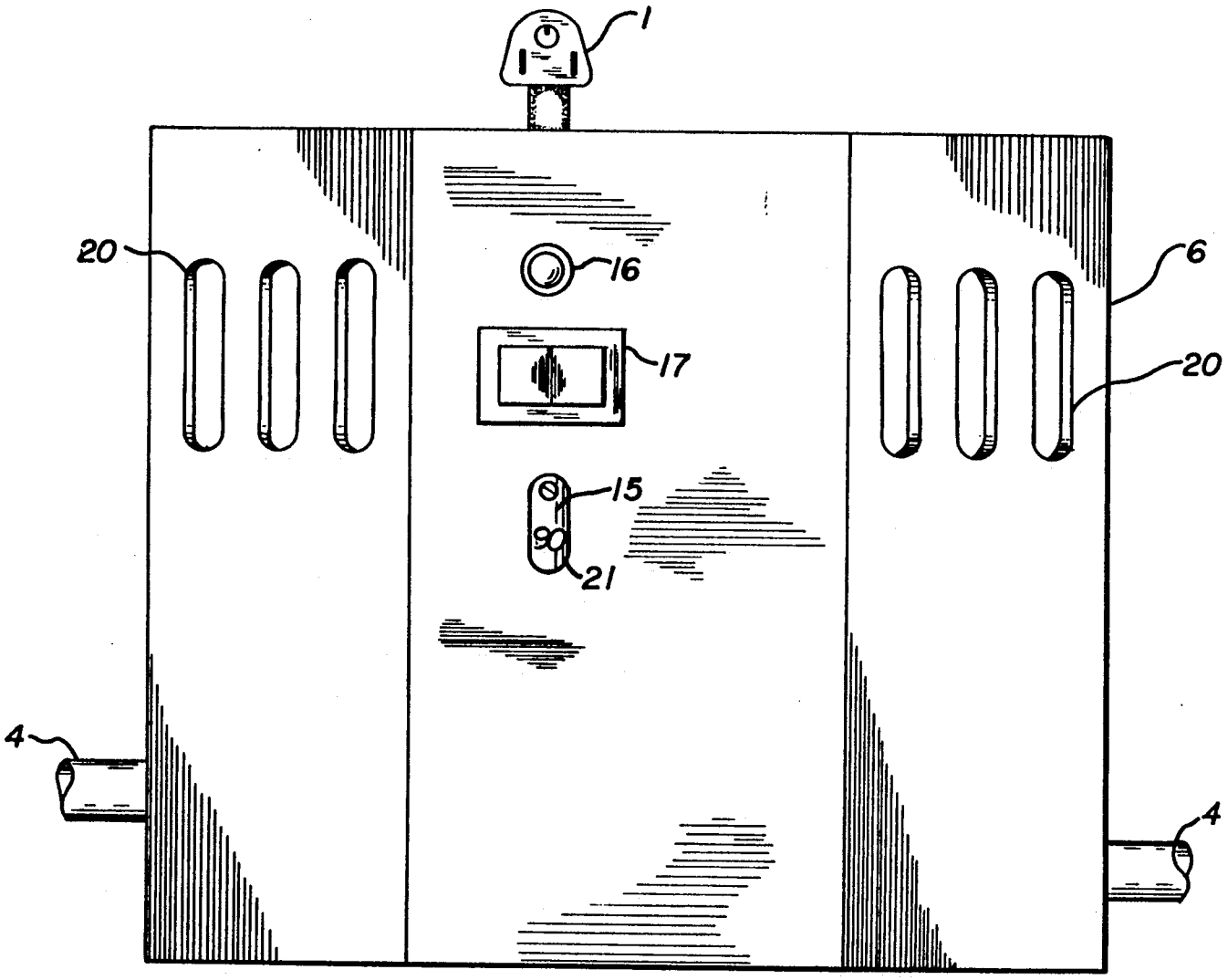
FIG. 4 is a top view of an encasement of FIG. 1 with Items 2, 3, 18 and sections of 4 intentionally omitted.
Figure 5:
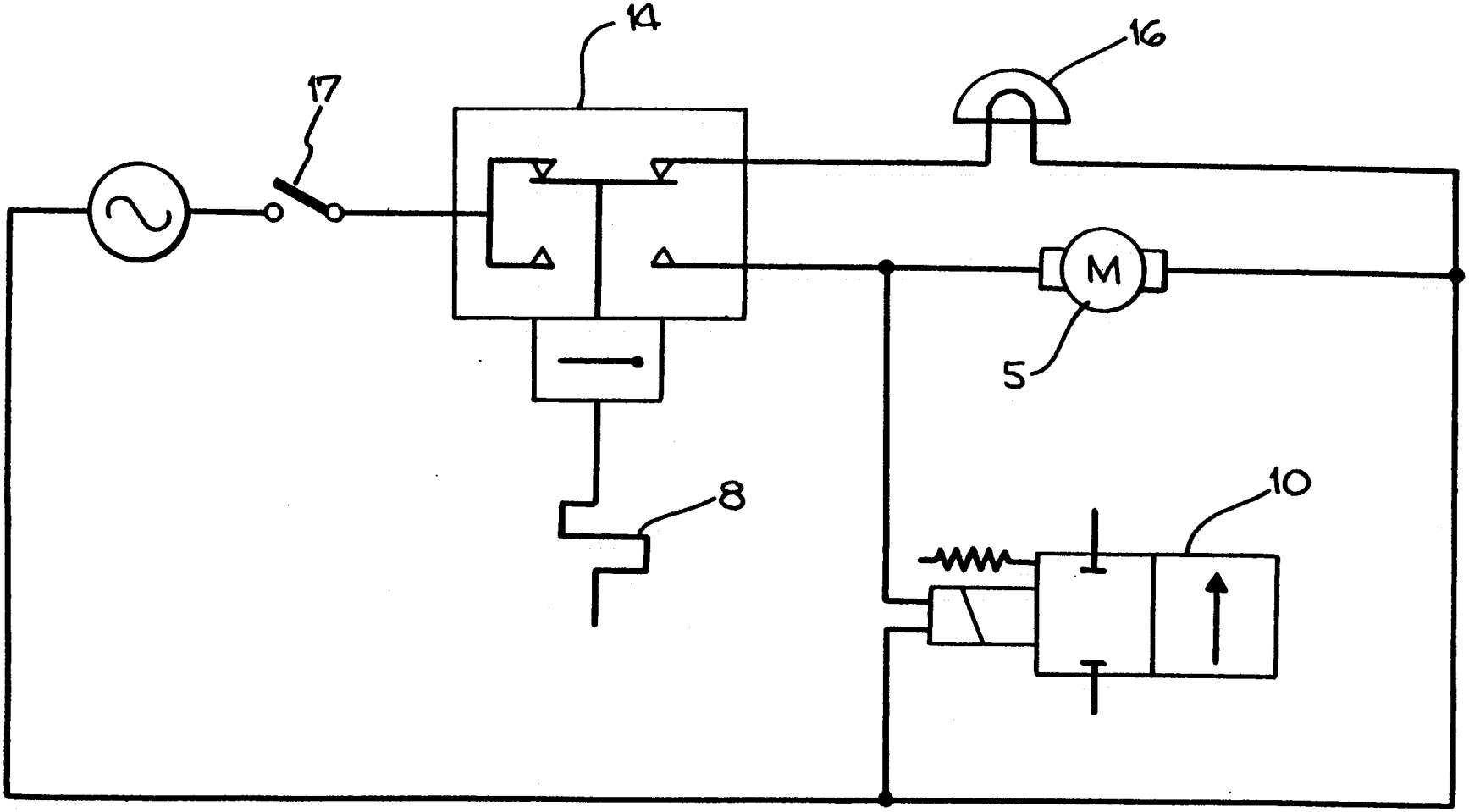
FIG. 5 is a wiring diagram of the water conservation device.

The unit power cord (1) is plugged into the electrical outlet. Both water valves (3) are opened. Power switch (17) is placed in "on" position. Thermostat (14) temperature selector dial (15) as shown in FIGS. 2 and 4 is set to a desired temperature. If the hot water line temperature at the inlet of the pump (5) as detected by the thermostat temperature sensor (8) is below the lower limit as pre-set by lower limit control (13), the thermostat switch (14) will switch power on through its normally open contacts to energize the electrical solenoid valve (10) and electrical pump (5) and open the normally closed contacts to turn the ready light (16) off. At this point hot water from tee (2) is guided through the inlet of the pump (5) through the solenoid (10) to the cold water line at tee (18). This water is guided into and through the cold water line. The circulation of water continues through the closed loop created by the opening of the solenoid valve (10) until the selected temperature on the dial (15) is sensed by the temperature sensor (8). At this time the thermostat switch (14) normally open contacts will open cutting off electrical power to the pump (5) and to deenergize the solenoid valve (10) and close the normally closed contacts to energize the ready light (16). The ready light (16) is a low power light. Any method that will inform the user that the selected water temperature has been achieved may be utilized and is within the scope and intent of the invention.

Figure 3:
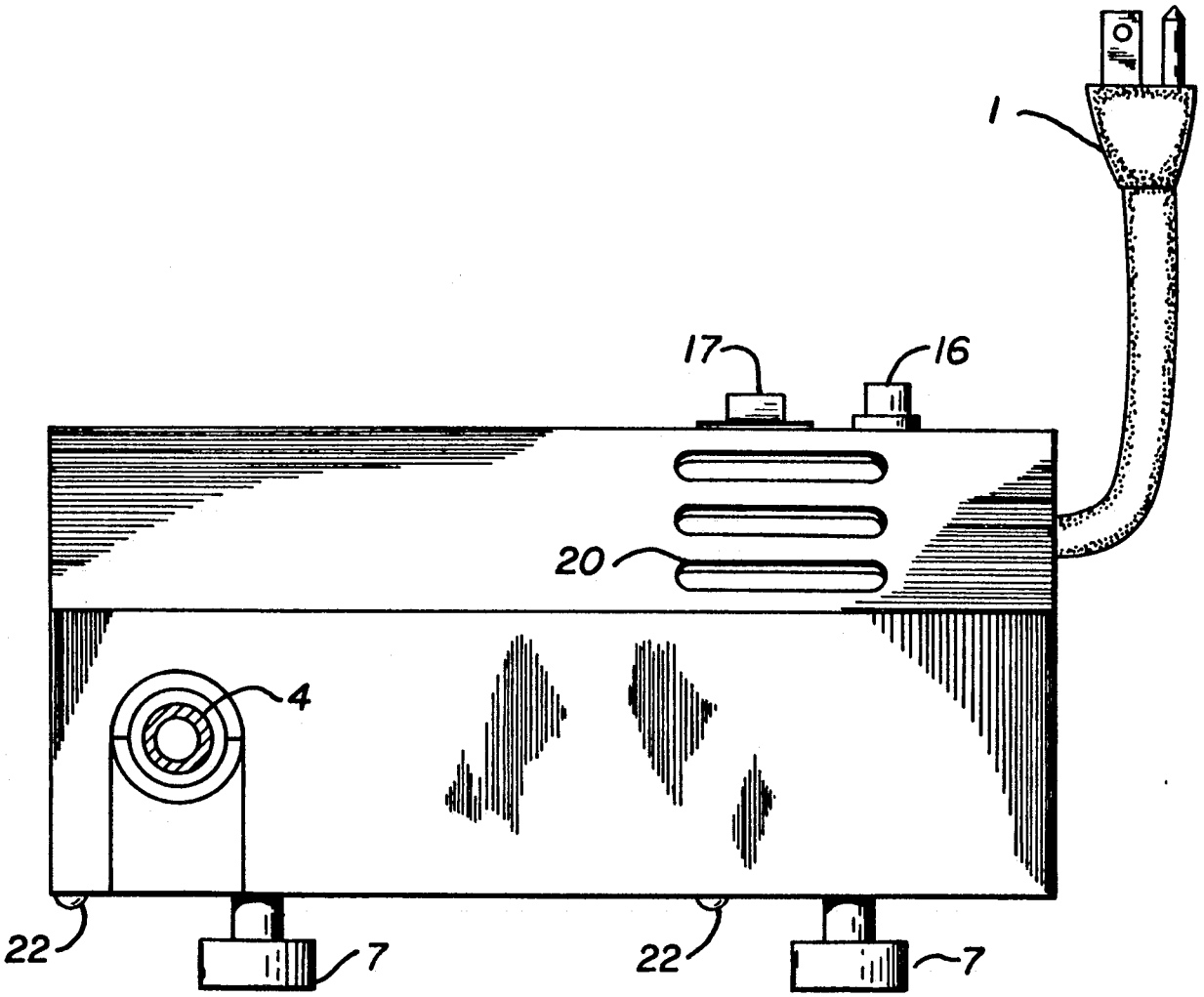
FIG. 3 is a right side view of an encasement of FIG. 1 with items 2, 3, 18 and sections of 4 intentionally omitted.

Other non-operational features as shown in FIG. 1 are insulator/noise dampner (9), electrical connection caps (19), and four feet (7). The insulator/noise dampner material can be rubber or any other suitable material that will serve the purpose of insulating the pump (5) and reducing possible noise during the operation of the device. Electrical connection caps (19) as shown in FIGS. 1 and 2 are included for better contact of the wires and safety. Four feet (7) as shown in FIGS. 1 and 3 are included to serve as a means of support for the unit housing (6) shown in FIGS. 1, 2, 3 and 4. It is to be understood that any variation in the arrangement or configuration of the feet or in the plurality of such structural features or the omission of said feet, are within the scope and intent of this invention.

An embodiment of the housing structure (6) is included in FIGS. 3 and 4, particularly, to show ventilation openings (20), a thermostat dial (15), and the viewing and adjustment opening (21).

Referring to FIG. 3, mounting screws (22) for the housing of the pump are shown. It is to be understood that any kind of mounting of the pump to the housing or variation in assembly, design or size of housing of the invention is within the scope and intent of the invention.

Figure 6:
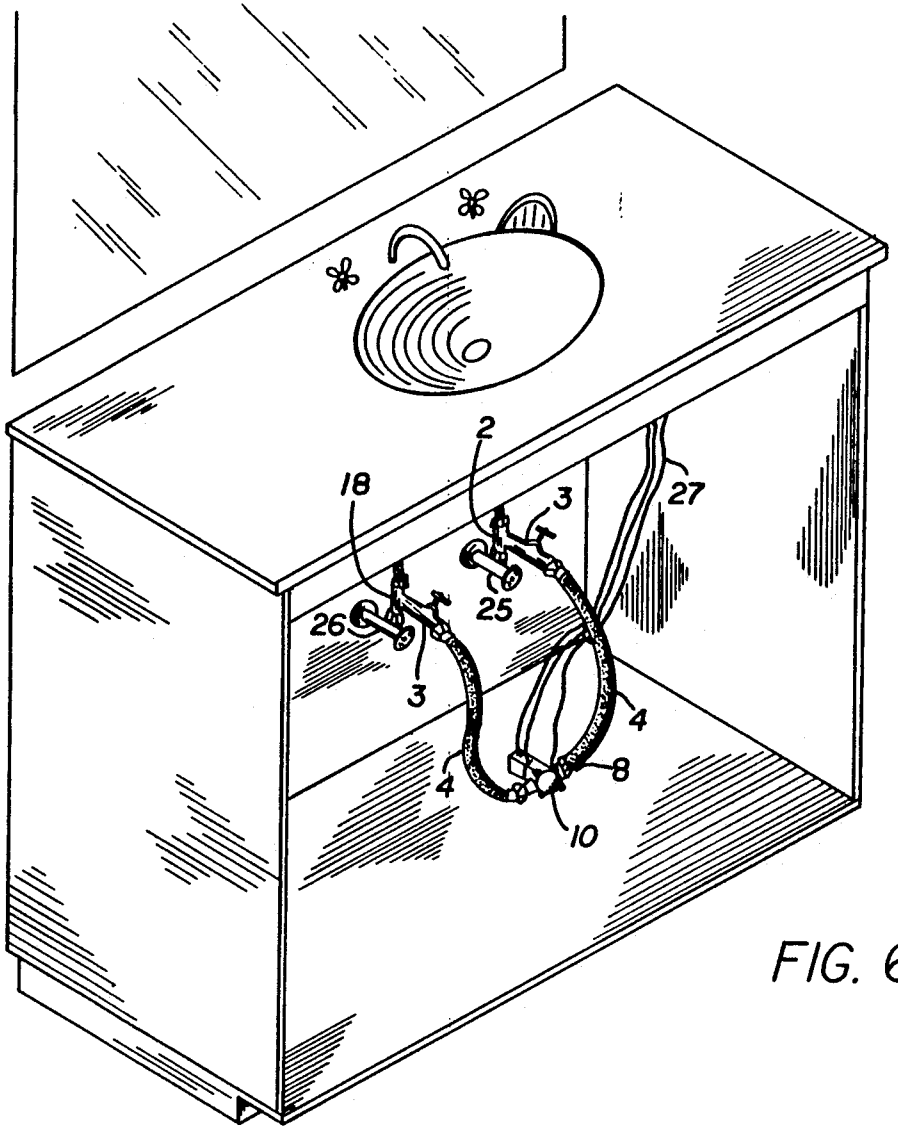
FIG. 6 is a view of Embodiment No. 2 of the water conservation device in which the water conservation device is installed on the water heater and in the desired water closets.

Referring to FIG. 6, Embodiment No. 2 of the invention is included to show a water conservation system to be constructed in new housing design. This system may be used in existing homes; although the same as Embodiment No. 1 in operation and result, the system related to Embodiment No. 2 will require more extensive plumbing and wiring work. The water conservation system related to Embodiment No. 2 is also designed so that a homeowner with common tools can install the system in their home for their own use.

Embodiment No. 2 as shown in FIG. 6 is shown as if installed in a typical home. The electrical pump (5) is installed at the cold water inlet (23) side of the house water heater (24). The thermostat (14) and power switch (17) are mounted on the electrical pump (5). The solenoid valve (10) together with the temperature sensor (8), flexible lines (4), valves (3), two tees (2 and 18), are installed between the hot (25) and cold (26) water lines under every sink (FIG. 6).

All wiring (27) from sensor (8), solenoid valve (10) is routed through the house attic to the respective locations on the thermostat (14) so that the system operates as indicated in Embodiment No. 1.

Any variation in the location or design of referenced parts, types of lines and threads, and types of housing for the pump or solenoid valve is within the scope and intent of the invention.

Any variation in the installation and materials, as long as the same purpose or objective is served, is within the scope and intent of the invention.

What is claimed is:

1. An improved water conservation device which may be installed in conjunction with existing and non-existing plumbing systems and fixtures having a source of pressurized water, a hot water supply line, a cold water supply line, a hot water heater, and outlet fixtures coupled to the hot and cold water supply lines, said device comprising:

a first tee fitting adapted for coupling to said hot water supply line;

a second tee fitting adapted for coupling to said cold water supply line;

a hot water supply line shut-off valve adapted for coupling to said first tee fitting;

a cold water supply line shut-off valve adapted for coupling to said second tee fitting;

an electrically controlled pump having an outlet port and an inlet port;

a first water line adapted for coupling to said hot water supply line shut-off valve and to said inlet port of said pump;

a solenoid valve having an input port connected to said outlet port of said pump for allowing mixture of hot and cold water while said pump is operating, and for preventing the mixture of hot and cold water when said pump is not operating;

a nipple fitting having one end adapted for coupling to the output end of said solenoid valve;

a second water line adapted for coupling to remaining open end of said nipple and to said cold water supply line shut-off valve;

an adjustable thermostat temperature selector for detecting the hot water temperature of said inlet of said pump;

a thermostat switch for energizing said solenoid valve and said pump;

a removable housing structure; and an indicator light for informing the user that the selected water temperature has been achieved.

2. An improved water conservation device according to claim 1 further comprising an on/off power switch for activating said device.

3. An improved water conservation device according to claim 2 wherein said housing structure comprises ventilation openings, a unit power cord opening, hot water and cold water inlet openings, an indicator light for informing the user that the selected hot water temperature has been achieved, and a thermostat adjusting means.

4. An improved water conservation device according to claim 1, wherein said first and said second water lines are constructed of flexible tubing.

5. An improved water conservation device according to claim 1 wherein said housing occupies a volume of approximately 3200.00 cubic centimeters.

* * * * *